US011029631B2

(12) United States Patent
Saeki

(10) Patent No.: US 11,029,631 B2
(45) Date of Patent: Jun. 8, 2021

(54) HEATING DEVICE, IMAGE PROCESSING APPARATUS, AND METHOD FOR MANUFACTURING THE HEATING UNIT

(71) Applicant: TOSHIBA TEC KABUSHIKI KAISHA, Tokyo (JP)

(72) Inventor: Ryota Saeki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/880,930

(22) Filed: May 21, 2020

(65) Prior Publication Data

US 2021/0063926 A1 Mar. 4, 2021

(30) Foreign Application Priority Data

Sep. 2, 2019 (JP) ..... JP2019-159387

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

2016/0216659 A1* 7/2016 Ikegami ..... G03G 15/2053
2018/0284664 A1* 10/2018 Imaizumi ..... G03G 15/2042

FOREIGN PATENT DOCUMENTS

JP H10-254270 A 9/1998
JP 2016-114876 A 6/2016

OTHER PUBLICATIONS

Product Information, "Specialty Greases, Molycote HP-300 Grease", Dow Corning Corporation, p. 1-2 (Year: 2000).*

* cited by examiner

*Primary Examiner* — Clayton E. LaBalle
*Assistant Examiner* — Michael A Harrison
(74) *Attorney, Agent, or Firm* — Kim & Stewart LLP

(57) ABSTRACT

A heating device includes a cylindrical film, a heater arranged inside the cylindrical film and extending along a longitudinal direction of the cylindrical film, a heat conductor extending along the longitudinal direction, and a first grease layer between the heater and the heat conductor and having a consistency grade less than or equal to three.

18 Claims, 6 Drawing Sheets

HEATING DEVICE, IMAGE PROCESSING APPARATUS, AND METHOD FOR MANUFACTURING THE HEATING UNIT

CROSS-REFERENCE TO RELATED APPLICATIONS

This application is based upon and claims the benefit of priority from Japanese Patent Application No. 2019-159387, filed on Sep. 2, 2019, the entire contents of which are incorporated herein by reference.

FIELD

Embodiments described herein relate generally to a heating device, an image processing apparatus, and a method for manufacturing the heating device.

BACKGROUND

An image forming apparatus for forming an image on a sheet has a fixing unit that heats the sheet to fix toner to the sheet. The fixing unit includes a rotatable cylindrical drum and a heating unit that abuts the inner surface of the cylindrical drum. In such a fixing unit, it is required to reduce deteriorations which might increase sliding friction between the heating unit and the cylindrical drum.

DETAILED DESCRIPTION

One or more embodiments provide a heating device, an image processing apparatus, and a manufacturing method of a heating unit.

A heating device according to an embodiment includes a cylindrical film configured to be rotated about an axis. The heating device includes a heater having a first side facing an inner surface of the cylindrical film. The heater extending along a longitudinal direction parallel to the axis. A heat conductor is on a second side of the heater opposite the first side. The heat conductor extends along the longitudinal direction. A first grease layer is between the heat conductor and the second side of the heater and has a consistency grade less than or equal to three A heating unit, an image processing apparatus, and a heating unit according to embodiments will now be described with reference to the drawings.

Figure 1:
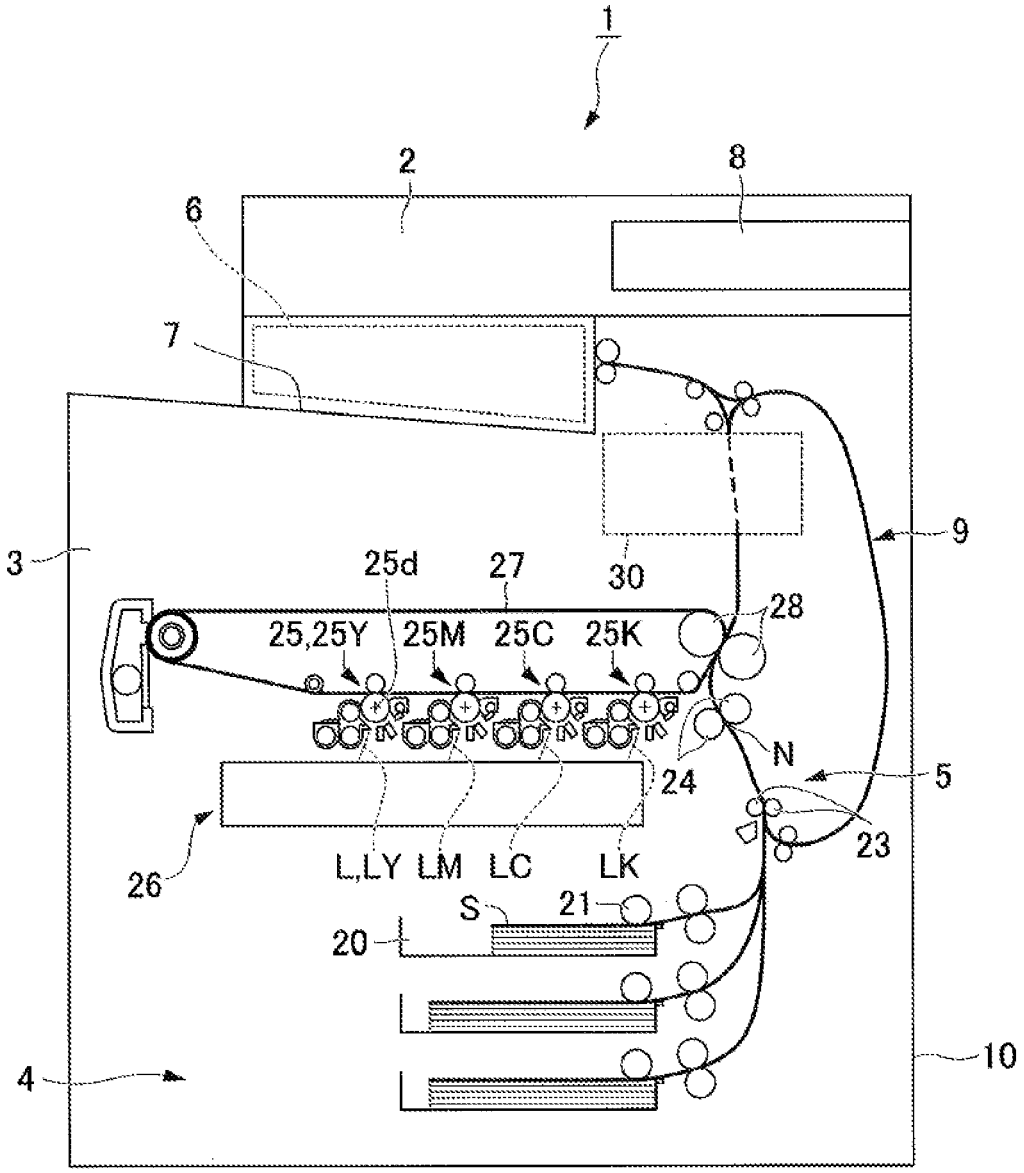
FIG. 1 is a schematic diagram of an image processing apparatus according to an embodiment.

FIG. 1 is a schematic diagram of an image processing apparatus 1 according to an embodiment. For example, the image processing apparatus 1 is an image forming apparatus such as a multifunction printer (MFP). The image processing apparatus 1 is configured to form an image on a sheet of paper S. The image processing apparatus 1 includes a housing 10, a scanner unit 2, an image forming unit 3, a sheet supply unit 4, a conveyance unit 5, a sheet discharge tray 7, an inversion unit 9, a control panel 8, and a control unit or a controller 6.

The housing 10 houses each component of the image processing apparatus 1.

The scanner unit 2 reads an image formed on a sheet as light and dark signals and generate an image signal of the image. The scanner unit 2 outputs the generated image signal to the image forming unit 3.

The image forming unit 3 forms an output image (such as a toner image) by using a recording agent (such as toner) according to the image signal received from the scanner unit 2 or an image signal received from another apparatus via a network. The image forming unit 3 transfers the output image onto the surface of the sheet S. When the output image is a toner image, the image forming unit 3 then heats and presses the toner image against the surface of the sheet S to fix the toner image to the sheet S.

The sheet supply unit 4 supplies sheets S one by one to the conveying unit 5 at a time synchronized with the timing at which the image forming unit 3 forms the toner image. The sheet supply unit 4 includes a sheet storage unit 20 and a pickup roller 21.

The sheet storage unit 20 stores a sheet S having a particular size and type.

The pickup roller 21 takes out the sheets S one by one from the sheet storage unit 20. The pickup roller 21 supplies the taken-out sheet S to the conveying unit 5.

The conveying unit 5 conveys the sheet S from the sheet supply unit 4 to the image forming unit 3. The conveying unit 5 includes a pressing roller 23 and registration rollers 24.

The conveying roller 23 conveys the sheet S from the pickup roller 21 to the registration rollers 24. The conveying roller 23 presses the leading end of the sheet S against a nip N formed by the registration rollers 24.

The registration rollers 24 adjust the sheet S position at the nip N to adjust the position of the leading end of the sheet S along the conveying direction. The registration rollers 24 then convey the sheet S along the conveying direction in accordance with the timing at which the image forming unit 3 transfers the toner image to the sheet S.

The image forming unit 3 includes a plurality of image forming units 25, a laser scanning unit 26, an intermediate transfer belt 27, a transfer unit 28, and a heating unit 30.

Each of the image forming units 25 includes a photosensitive drum 25*d*. Each image forming unit 25 forms a toner image corresponding to the image signal received from the scanner unit 2 or another apparatus on the corresponding photosensitive drum 25*d*. The image forming units 25Y, 25M, 25C and 25K form toner images of yellow, magenta, cyan and black toners, respectively.

A charging device, a developing device, and the like are disposed around each photosensitive drum 25*d*. The charging device electrostatically charges the surface of the corresponding photosensitive drum 25*d*. Each developing device contains developer including one of yellow, magenta, cyan and black toners. The developing device develops an electrostatic latent image formed on the photosensitive drum 25*d*. As a result, a toner image is formed on each photosensitive drum 25*d* by the corresponding color of toner.

The laser scanning unit 26 scans each charged photosensitive drum 25*d* with a laser beam L to selectively expose the photosensitive drum 25*d* according to image data to be printed. The laser scanning unit 26 exposes the photosensitive drum 25*d* of each of the image forming units 25Y, 25M, 25C and 25K with the corresponding laser beam LY, LM, LC and LK. In this manner, the laser scanning unit 26 forms the electrostatic latent image on each photosensitive drum 25*d*.

The toner image formed on the surface of each photosensitive drum 25*d* is first transferred (primary transfer) to the intermediate transfer belt 27.

The transfer unit 28 next transfers the toner image on the intermediate transfer belt 27 onto the surface of the sheet S at a secondary transfer position.

The heating unit 30 heats the toner image that has been transferred to the sheet S to fix the toner image on the sheet S.

The inversion unit 9 inverts the sheet S in order to form an image on the back surface of the sheet S. The inversion unit 9 reverses the sheet S after the sheet S has passed the heating unit 30 by a switch-back or the like. The inversion unit 9 conveys the inverted sheet S back to the registration rollers 24 by a switch-back route or path.

The sheet discharge tray 7 holds the printed sheets S after discharge from the heating unit 30.

The control panel 8 is an input unit for an operator to input information to operate the image processing apparatus 1. The control panel 8 includes a touch panel and various hardware keys.

The control unit 6 controls each unit of the image processing apparatus 1.

Figure 2:
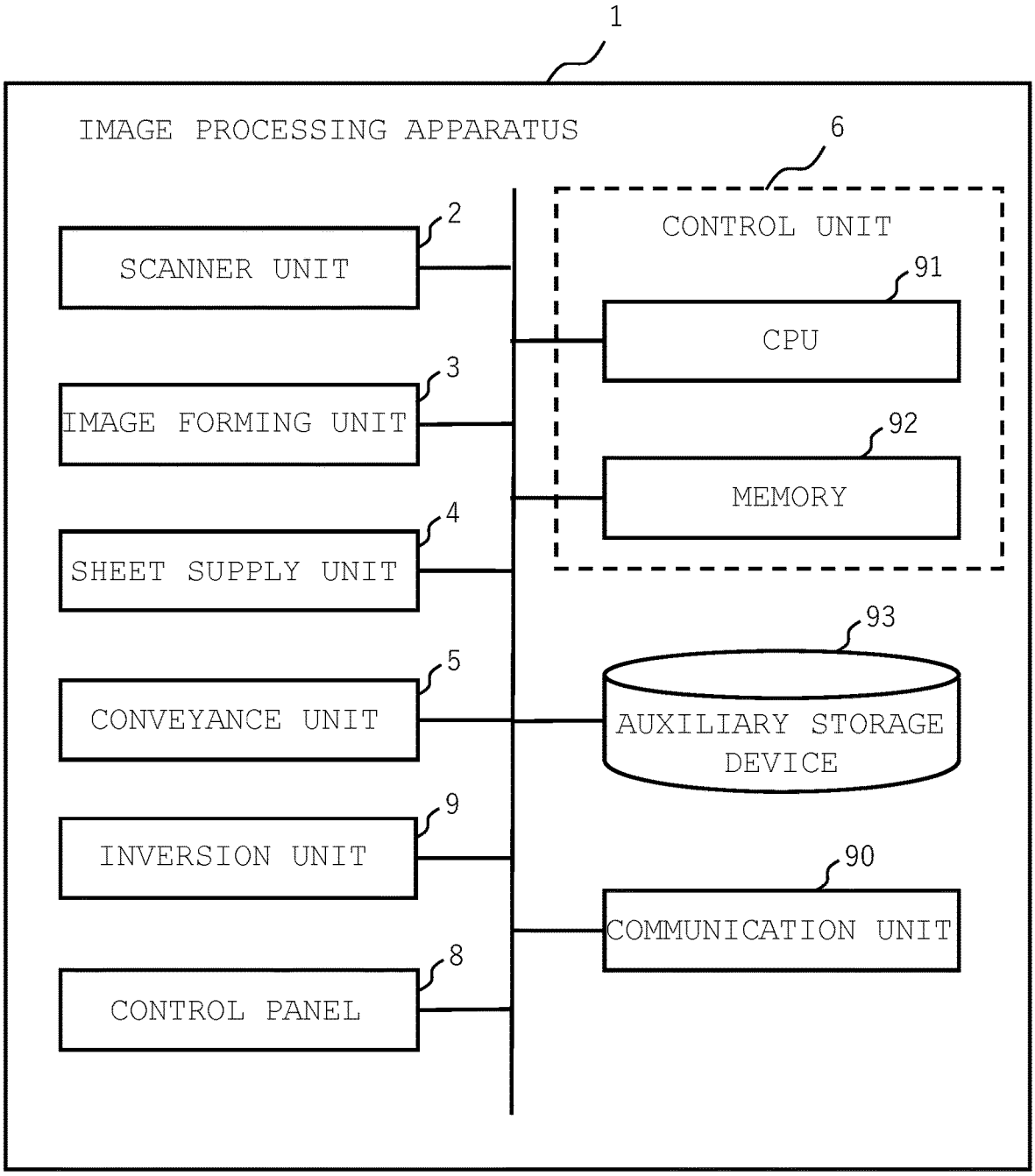
FIG. 2 is a hardware block diagram of an image processing apparatus.

FIG. 2 is a hardware block diagram of the image processing apparatus 1. The image processing apparatus 1 includes the scanner unit 2, the image forming unit 3, the sheet supply unit 4, the conveyance unit 5, the inversion unit 9, the control panel 8, the control unit 6, an auxiliary storage device 93, and a communication unit 90. Those components are connected by a bus. The control unit 6 includes a CPU (Central Processing Unit) 91 and a memory 92, and is configured to execute a program or programs to control each unit of the image processing apparatus 1.

The CPU 91 executes programs stored in the auxiliary storage device 93 and loaded onto the memory 92. The CPU 91 controls the operation of each unit of the image processing apparatus 1.

The auxiliary storage device 93 is a storage device such as a magnetic hard disk device (HDD) or a semiconductor storage device (SSD). The auxiliary storage device 93 stores programs to be executed by the CPU 91 and information required or generated by the programs.

The communication unit 90 is a network interface for communicating with an external apparatus via a network.

Figure 3:
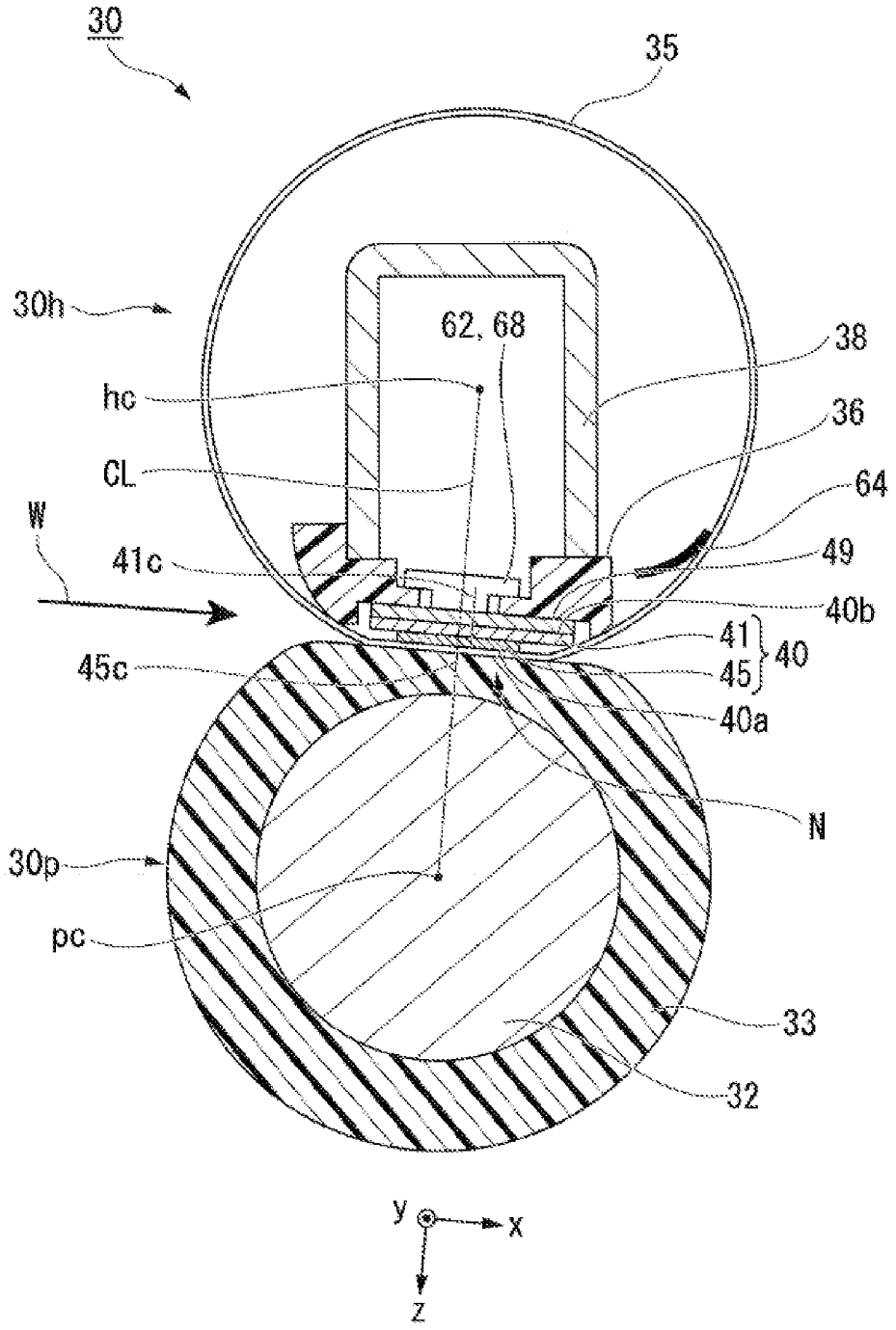
FIGS. 3 and 4 are cross-sectional views of aspects of a heating unit.

FIG. 3 is a cross-sectional view of the heating unit 30 according to an embodiment. For example, the heating unit 30 is a fixing unit. The heating unit 30 includes a pressing roller 30*p* and a heated roller 30*h*. The heated roller 30*h* may be referred to in some contexts as a heating drum, fixing belt, or a film unit.

The pressing roller 30*p* forms a nip N with the heated roller 30*h*. The pressing roller 30*p* presses the toner image formed on the sheet S that has entered the nip N. The pressing roller 30*p* rotates to convey the sheet S. The pressing roller 30*p* includes a core metal 32, an elastic layer 33, and a release layer (not separately depicted).

The core metal 32 is formed in a columnar shape by a metal material such as stainless steel. Both end portions in the axial direction of the core metal 32 are rotatably supported. The core metal 32 is driven to rotate by a motor or the like. The core metal 32 comes into contact with a cam member or the like. The cam member can be rotated to move the core metal 32 toward and away from the heated roller 30*h*.

The elastic layer 33 is formed of an elastic material such as silicone rubber. The elastic layer 33 has a constant thickness on the outer peripheral surface of the core metal 32.

The release layer is formed of a resin material such as PFA (tetrafluoroethylene perfluoroalkyl vinyl ether copolymer). The release layer is formed on the outer peripheral surface of the elastic layer 33.

For example, the hardness of the outer peripheral surface of pressing roller 30*p* is 40°-70° at a load of 9.8 N by an ASKER-C hardness meter. Thus, the area of the nip N and the durability of the pressing roller 30*p* are secured.

The pressing roller 30*p* is able to move toward and away from the heated roller 30*h* by rotation of the cam member. The pressing roller 30*p* is moved toward the heated roller 30*h* and presses it with a pressing spring to form a nip N. On the other hand, when the sheet S is jammed in the heating unit 30, the pressing roller 30*p* can be separated from the heated roller 30*h*, whereby the jammed sheet S can be removed. Further, during sleep or an idle state, rotation of the cylindrical film 35 is stopped and the pressing roller 30*p* is moved away from the heated roller 30*h*, thereby preventing unnecessary plastic deformation of the cylindrical film 35.

The pressing roller 30*p* is rotated by a motor. When the pressing roller 30*p* rotates while the nip N is formed, the cylindrical film 35 of the heated roller 30*h* is driven to rotate. The pressing roller 30*p* rotates to convey the sheet S in the conveying direction W through the nip N.

The heated roller 30*h* heats the toner image on the sheet S in the nip N. The heated roller 30*h* includes a cylindrical film 35, a heater 40, a heat conductor 49, a support member 36, a stay 38, a heater temperature sensor 62, a thermostat 68, and a film temperature sensor 64.

The cylindrical film 35 has a cylindrical shape. The cylindrical film 35 includes a base layer, an elastic layer, and a release layer in this order from the inner peripheral side thereof. The base layer is a material such as nickel (Ni) or the like. The elastic layer is laminated on the outer peripheral surface of the base layer. The elastic layer is formed of an elastic material such as silicone rubber. The release layer is applied on the outer peripheral surface of the elastic layer. The release layer is formed of a material such as a PFA resin.

Figure 4:
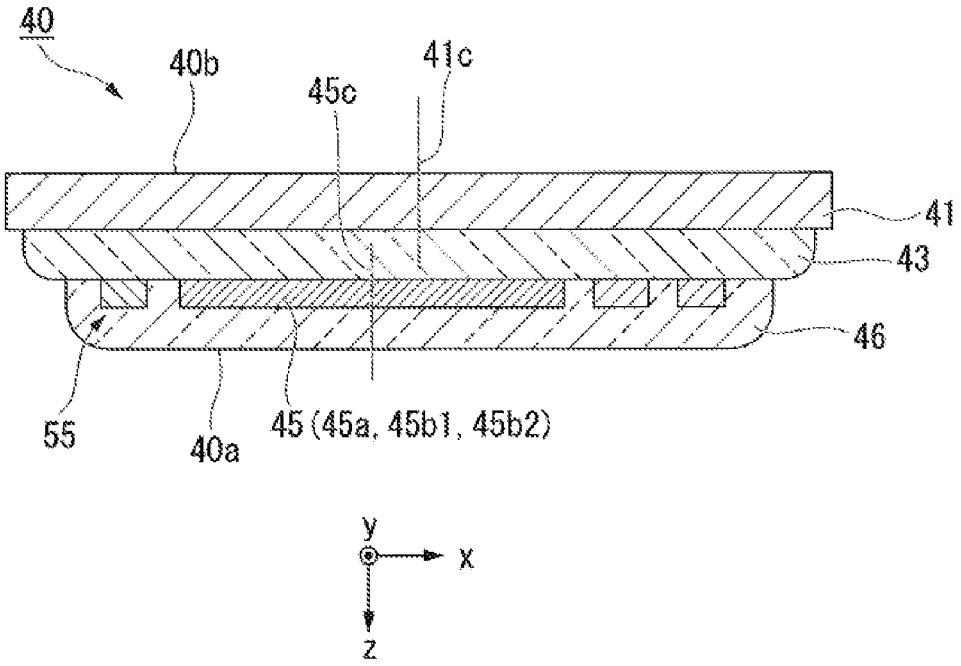
Figure 5:
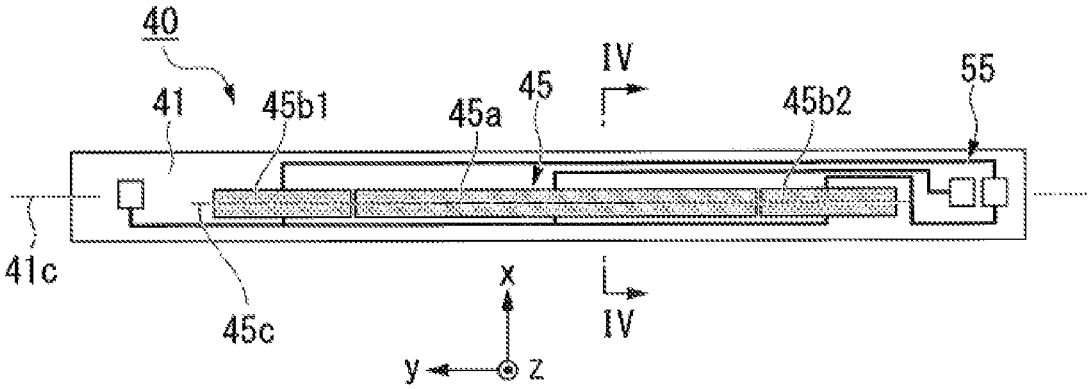
FIG. 5 is a bottom view of a heating unit.

FIG. 4 is a cross-sectional view of the heating unit 30 taken along the IV-IV line of FIG. 5. FIG. 5 is a bottom view of the heating unit when viewed from the +z direction. The heater 40 includes a substrate 41, a heating element group 45, and a ring set 55.

The substrate 41 is made of a metal material such as stainless steel or a ceramic material such as aluminum nitride. The substrate 41 has a long rectangular plate shape. The substrate 41 is arranged inside the cylindrical film 35. The longitudinal direction of the substrate 41 is parallel to the axis of the cylindrical film 35.

In the present disclosure, the x direction, the y direction, and the z direction are defined as follows. The y direction is parallel to the longitudinal direction of the substrate 41. The +y direction is a direction from a central heating element 45*a* toward a first end heating element 45*b*1. The x direction is parallel to the lateral direction of the substrate 41. The +x direction corresponds to the transport direction of the sheet S during printing operations. The z direction is a normal direction of the substrate 41. The +z direction is the direction from the substrate 41 to the heating element group 45. The insulating layer 43 is formed on the surface of the substrate 41 on the +z direction side by a glass material or the like.

As shown in FIG. 5, the heating element group 45 is disposed above the substrate 41. The heating element group 45 is formed of a silver-palladium alloy or the like. The heating element group 45 has a rectangular shape in which the long side extends along the y direction and the short side extends along the x direction. The center 45*c* in the x direction of the heating element group 45 is offset to the −x direction from the center 41*c* of the substrate 41 (the heater unit 40).

The heating element group 45 includes a first end heating element 45*b*1, a central heating element 45*a*, and a second end heating element 45*b*2 arranged side by side along the y direction. The central heating element 45*a* is disposed in the center portion of the heating element group 45 in the y direction. The first end heating element 45*b*1 is located at the end of the heating element group 45 in the +y direction adjacent to the central heating element 45*a*. The second end heating element 45*b*2 is arranged adjacent to the central heating element 45*a* in the −y direction and at the end of heating element group 45 in the −y direction.

The heating element group 45 generates heat when energized. A sheet S having only a small width in the y direction can be positioned to pass through the center portion of the heating unit 30. In such a case, the control unit 6 causes only the central heating element 45*a* to generate heat. On the other hand, when a sheet S has a large width in the y direction, the control unit 6 causes the entire heating element group 45 to be energized. The central heating element 45*a* and the first and second end heating elements 45*b*1 and 45*b*2 can be independently controlled in heat generation. Also, the first end heating element 45*b*1 and the second end heating element 45*b*2 can be similarly controlled to one another during heat generation.

As shown in FIG. 4, the heating element group 45 and the ring set 55 are formed on the surface of the insulating layer 43 on the +z direction side. A protective layer 46 is formed of a glass material or the like so as to cover the heating element group 45 and the ring set 55. The protective layer 46 improves the sliding property (reduces friction) between the heater 40 and the cylindrical film 35.

Similarly to the insulating layer 43 formed on the substrate 41 on the +z direction side, an insulating layer may be formed on the substrate 41 on the −z direction side. Similarly to the protective layer 46 formed on the substrate 41 on the +z direction side, a protective layer may be formed above the substrate 41 on the −z direction side. Thus, the warpage of the substrate 41 is suppressed.

As shown in FIG. 3, the heater 40 is disposed inside the cylindrical film 35. That is, the heater 40 is disposed inside a region surrounded by the cylindrical film 35. A straight line CL connecting the center pc of the pressure roller 30*p* and the center hc of the heating drum 30*h* is depicted in FIG. 3. The center 41*c* in the x direction of the substrate 41 is shifted in the +x direction from the straight line CL. The center 45*c* of the heating element group 45 in the x direction is disposed on the straight line CL. The heating element group 45 is entirely included within the region of the nip N, and is disposed at the center of the nip N. Thus, the heat distribution of the nip N becomes more uniform, and a sheet S passing through the nip N will be more uniformly heated.

The heat conductor 49 is formed of a metal material having high thermal conductivity, such as copper. The outer shape (planar shape when viewed from the z direction) of the heat conductor 49 is matches the outer shape (planar shape when viewed from the z direction) of the substrate 41 of the heater 40. The heat conductor 49 is disposed in contact with at least a part of the second surface 40*b* on the −z direction side of the heater 40.

The support member 36 is made of a resin material such as a liquid crystal polymer. The support member 36 is disposed so as to cover the surface on the −z direction side of the heater 40 and the both sides in the x direction. The support member 36 supports the heater 40 via the heat conductor 49. Both end portions in the x direction of the support member 36 are curved to support the inner peripheral surface of the cylindrical film 35 at both end portions in the x direction of the heater 40.

When a sheet S passing through the heating unit 30 is heated, a temperature distribution is generated across the heater 40 in accordance with the size of the sheet S. The local temperature of parts of the heater 40 may become a locally high temperature, such temperatures may exceed the upper-temperature limit of the support member 36 formed of resin material. The heat conductor 49 functions to average or smooth the local temperature distribution of the heater 40. Thus, the support member 36 can be prevented from being overheated locally.

The stay 38 is formed of a steel sheet material or the like. A cross section of the stay 38 perpendicular to the y direction has a U shape. The stay 38 is mounted on the support member 36 on the −z direction side so as to cover the opening of the U shape along with the support member 36. The stay 38 extends along the y direction. Both end portions in the y direction of the stay 38 are fixed to the housing of the image processing apparatus 1. As a result, the heating drum 30*h* is supported by the image processing apparatus 1. The stay 38 improves the rigidity of the heated roller 30*h*. A flange for restricting the movement of the cylindrical film 35 in the y direction is provided in the vicinity of both end portions in the y direction of the stay 38.

The heater temperature sensor 62 is disposed on the heat conductor 49. The heater temperature sensor 62 is mounted on a surface of the support member 36 on the −z direction side. The heater temperature sensor 62 contacts the heat conductor 49 through a hole through the support member 36 in the z direction. The heater temperature sensor 62 measures the temperature of the heater 40 via the heat conductor 49.

The thermostat 68 is arranged similarly to the heater temperature sensor 62. The thermostat 68 interrupts the energization to the heating element group 45 when the temperature of the heater 40 detected through the heat conductor 49 exceeds a predetermined temperature.

The film temperature sensor 64 is disposed inside the cylindrical film 35 and adjacent to the support member 36 in the +x direction. The film temperature sensor 64 is brought into contact with the inner peripheral surface of the cylindrical film 35 to measure the temperature of the cylindrical film 35.

Figure 6:
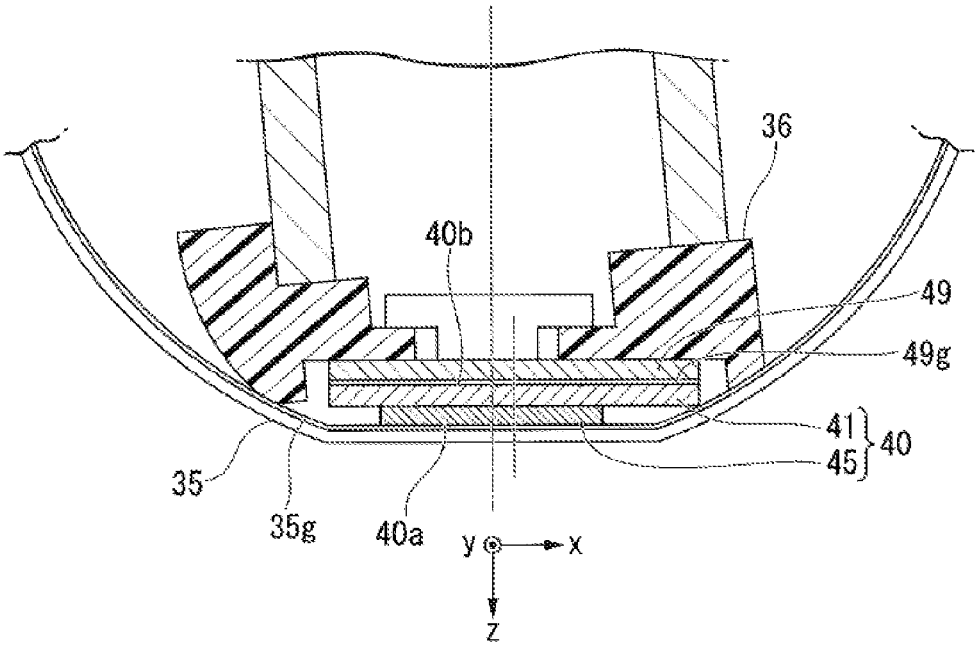
FIG. 6 is an enlarged view of a heating unit.

The grease applied to the heating unit 30 will now be described. FIG. 6 is an enlarged view of the heating unit 30. The heating unit 30 includes a first grease layer 49*g* and a second grease layer 35*g*. The second grease layer 35*g* covers the entire inner surface of the cylindrical film 35. The first surface 40*a* on the +z direction side of the heater comes into contact with the inner surface of the cylindrical film 35 via the second grease layer 35*g*. When the heater 40 generates heat, the viscosity of the second grease layer 35*g* decreases. Thus, the sliding between the heater 40 and the cylindrical film 35 is improved (friction is reduced).

The second grease layer 35*g* includes fluoro-grease comprising a fluorinated oil as a base oil. The fluoro-grease has high heat resistance, low viscosity, and long life (good stability). The second grease layer 35*g* contains, for example, PTFE (polytetrafluoroethylene) as a thickening agent. The consistency grade of the second grease layer 35*g* is two or less, which corresponds to 265 (1/10 mm) or more in working penetration as measured by a test method specified in Japanese Industrial Standard (JIS) K2220:2013. For example, the consistency grade of the second grease layer 35*g* is zero or less, which corresponds to 355 (1/10 mm) or more in the working penetration.

In general, in order to improve heat transfer between adjacent objects, a high thermal conductivity grease can be applied between the objects. The high thermal conductivity grease typically includes: thermally conductive filler material such as silicon, carbon, aluminum or zinc. The thermal conductivity of the high thermal conductivity grease is on the order of 5.0 W/m·K on average, and can be about 10.0 W/m·K at maximum. The thermally conductive filler material typically has a large particle diameter and a high hardness. When a thermally conductive filler is on a sliding surface (friction surface), abrasion of the sliding surface proceeds rapidly, and properties of the sliding surface are ultimately worsened. For such a reason, unlike a thermally conductive grease, the second grease layer 35*g* does not include a thermally conductive filler material. The thermal conductivity of the second grease layer 35*g* is, as a result, equal to or less than 1.0 W/m·K.

The first grease layer 49*g* is disposed between the heater 40 and the heat conductor 49. The second surface 40*b* on the −z direction side of the heater 40 comes into contact with the heat conductor 49 via the first grease layer 49*g*. Various irregularities are present at the contacting surfaces of the heater 40 and the heat conductor 49. In particular, when a glass layer is formed on the second surface 40*b* of the heating unit 30, a large unevenness is typically present on the surface of the glass layer. When the first grease layer 49*g* covers and fills the concave and convex portions of the surface, the heat conductivity between the heater 40 and the heat conductor 49 is improved.

However, the first grease 49*g* is not a high thermal conductivity grease and does not contain a thermally conductive filler. The thermal conductivity of the first grease layer 49*g* is equal to or less than 1.0 W/m·K. For example, the thermal conductivity of the first grease layer 49*g* is about 0.01 W/m·K. As described above, a high thermal conductivity grease improves heat conductivity between adjacent objects. In order to prevent the high thermal conductivity grease from flowing out from between the objects to which it is applied, the high thermal conductivity grease is generally fairly viscous even at high temperatures. The consistency grade of the high thermal conductivity grease is four or more, which corresponds to 205 (1/10 mm) or less in the working penetration.

The first grease layer 49*g* includes fluoro-grease comprising a fluorinated oil as a base oil. The first grease layer 49*g* contains PTFE (polytetrafluoroethylene) as a thickening agent. The consistency grade of the first grease layer 49*g* is three or less, which corresponds to 220 (1/10 mm) or more in the working penetration. By adjusting the blending ratio of the base oil and the thickener, the consistency of the first grease layer 49*g* can be adjusted.

For example, the first grease layer 49*g* can be the same as the second grease layer 35*g*. In such a case, the consistency grade of the first grease layer 49*g* is not more than two, preferably not more than zero. The first grease 49*g* also does not include a thermally conductive filler. The thermal conductivity of the first grease layer 49*g* is equal to or less than 1.0 W/m·K. Since the same type of grease can be used for the first grease layer 49*g* and the second grease layer 35*g*, the manufacturing cost is reduced.

When the heater 40 generates heat, the viscosity of the first grease layer 49*g* decreases. Accordingly, a part of the first grease layer 49*g* may flow out from the second surface 40*b* side of the heater 40 and reach the first surface 40*a*. The consistency grade of the first grease layer 49*g* is three or less and is approximately the same as that of the second grease layer 35*g*. Since the first grease layer 49*g* does not include a thermally conductive filler, potential abrasion of the sliding surface by such a thermally conductive filler can be avoided.

TABLE 1

| | RETURN TIME [SEC] | AVERAGE POWER [W] IN WU WHOLE | IN PRINTING WHOLE | CENTER PORTION | END PORTION | HEATER END TEMPERATURE [° C.] FRONT SIDE | REAR SIDE |
|---|---|---|---|---|---|---|---|
| COMPARATIVE EXAMPLE (HIGH THERMAL CONDUCTIVITY GREASE) | 9.9 | 1062.7 | 680.3 | 327 | 353.3 | 240.55 | 223.65 |
| EXAMPLE (FULORINE GREASE) | 9.6 | 1058.3 | 681.6 | 325.7 | 355.9 | 239.8 | 222.5 |

Table 1 is a comparative table of characteristics of a high thermal conductivity grease as a comparative example and a fluoro-grease according the example embodiments described above. Table 1 shows measurement results relating to various performance parameters when these different grease types are utilized as to the first grease layer 49*g* in an image processing apparatus.

The "Return Time" column in Table 1 includes values indicating how long the heater 40 took to change from room temperature to the fixing temperature for. The measured return time for the comparative example is 9.9 seconds, whereas the measured return time for the example embodiments is 9.6 seconds. For the embodiments, it is considered that the heat from the heater 40 is less transmitted to the heat conductor 49 (via the fluoro-grease) than in the comparative example (using the high thermal conductivity grease), so that the return time is shortened.

The "Average Power" column group in Table 1 provides values for power consumption calculated from the on-off ratio of the heating element group 45 during the relevant time period. For the column "In WU (warm-up)" in Table 1, the value represents the average power utilized by the heater in a return to the fixing temperature from room temperature. In the experiments presented in Table 1, for both "In WU" and "In Printing," time periods, the entire heat generating element group 45 is energized (that is, the center heat generating element 45*a*, the first end heat generating element 45*b*1, and the second end heat generating element 45*b*2 are each turned on to generate heat). The columns labeled "Whole" in Table 1 indicates the total power consumption for the entire heating element group 45. The column labeled "central portion" in Table 1 indicates the power consumption of just the central heating element 45*a* from among the heating element group 45. The "End Portion" column in Table 1 indicates the power consumption of the first end heating element 45*b*1 and second end the heating element 45*b*2 from among heating element group 45.

In general, there is little difference between the comparative example and the embodiments in the measured average power utilized for heating.

The "Heater End Temperature" column group in Table 1 records the maximum temperature of the second surface 40*b* of the heater 40 in a non-paper passing region (such as a region beyond the sheet S passing region of the heater 40 in the y direction) of the heating unit 30. The "Front Side" column in Table 1 provides measured temperature values of the front side (one side in the y direction) of the image processing apparatus 1. The "Rear side" column provides measured temperatures of the rear side (the other side in the y direction opposite the front side) of the image processing apparatus 1. The reason why there is a temperature difference between the front side and the rear side is that the center of the passing sheet S in the y direction is shifted with respect to the center in the y direction of the heating unit 30.

Since the non-sheet-passing area of the heating unit 30 is not cooled by the passing sheet S, this area tends to reach a high temperature. In comparison with the comparative example, since the thermal conductivity of the first grease layer 49*g* is small, heat is less well transferred from the heater 40 to the heat conductor 49. Therefore, in the embodiments, as compared to the comparative example, the second surface 40*b* of the heater 40 in the non-sheet-passing region tends to become a higher temperature. However, in the results shown in Table 1, the temperature difference between the front side and the rear side is small in comparison with the comparative example. Since the spacing distance between the heater 40 and the heat conductor 49 is small, even when the first grease layer 49*g* of the embodiments has low thermal conductivity, heat transfer is not greatly inhibited.

A method of manufacturing the heating unit 30 will now be described.

The second grease layer 35*g* is applied to the entire inner surface of the cylindrical film 35. Thereafter, the heater 40 is inserted inside the cylindrical film 35. Thus, the second grease layer 35*g* can always be interposed between the rotating cylindrical film 35 and the heater 40.

The first grease layer 49*g* is disposed between the heater 40 and the heat conductor 49. That is, the first grease layer 49*g* is applied to either one or both of the second surface 40*b* of the heater 40 and the first surface 49*a* of the heat conductor 49 before these elements are brought together. Subsequently, the heat conductor 49 is disposed on the second surface 40*b* of the heater 40. As a result, the first grease layer 49*g* is disposed between the heater 40 and the heat conductor 49. Therefore, heat transfer between the heater 40 and the heat conductor 49 is improved by the presence of the first grease layer 49*g*.

When the first grease layer 49*g* and the second grease layer 35*g* are formed of the same material, the following manufacturing method may be adopted. The first grease layer 49*g* is not disposed between the heater 40 and the heat conductor 49 in advance. The heat conductor 49 is then arranged on the second surface 40*b* of the heater 40. Next, the heating element group 45 is caused to generate heat. For example, the heating element group 45 is heated by the heating device 30. Accordingly, the viscosity of the second grease layer 35*g* applied to the inner surface of the cylindrical film 35 is reduced, so that the second grease layer 35*g* can flow into the gap between the second surface 40*b* and the heat conductor 49. That is, the second grease layer 35*g* flows from the first surface 40*a* of the heater 40 to the second surface 40*b*, and enters between the heater 40 and the heat conductor 49. Thus, the second grease layer 35*g* that flows to the second surface 40*b* from the first surface 40*a* can function as the first grease layer 49*g*.

In this manufacturing method, the first grease layer 49*g* is not required to be applied between the heater 40 and the heat conductor 49 in advance. Therefore, the manufacturing process can be simplified and the manufacturing cost reduced.

As described above, the heating unit 30 of the embodiments includes the cylindrical film 35, the heating element group 45, the heater 40, the heat conductor 49, and the first grease layer 49*g*. The heating element group 45 is located inside the cylindrical film 35. The heater 40 has the heating element group 45. The heater 40 has a longitudinal direction in the y direction. The heater 40 is in contact with the inner surface of the cylindrical film 35 on the first surface 40*a*. The heat conductor 49 is disposed on the second surface 40*b* opposite to the first surface 40*a* of the heater 40. The heat conductor 49 extends in the y direction along the heater 40. The first grease layer 49*g* is disposed between the heater 40 and the heat conductor 49. The first grease layer 49*g* has a consistency grade of no more than three.

When the heater 40 generates heat, the viscosity of the first grease layer 49*g* decreases. Accordingly, a part of the first grease layer 49*g* may flow out from between the heater 40 and the heat conductor 49, and may reach into the sliding surface between the heater 40 and the cylindrical film 35. However, since the first grease layer 49*g* has a consistency grade of no more than three, it is possible to suppress any deterioration in the slidability between the heater 40 and the cylindrical film 35.

The first grease layer 49*g* does not include thermally conductive filler. The first grease layer 49*g* has a thermal conductivity of 1.0 W/m·K or less.

As described above, the first grease layer 49*g* may enter the sliding surface between the heater 40 and the cylindrical film 35. However, since the first grease layer 49*g* does not include a thermally conductive filler, the potential abrasion of the sliding surface by a thermally conductive filler is avoided. Therefore, it is possible to avoid sliding friction increases between the heater 40 and the cylindrical film 35.

While the first grease layer 49*g* has a thermal conductivity of 1.0 W/m·K or less, the gap left between the heater 40 and the heat conductor 49 is relatively small, so that heat will still be able to be sufficiently transferred between these elements via the first grease layer 49*g*. Since the temperature distribution across the length heater 40 is still averaged by the presence of heat conductor 49, the temporary suspension of the printing or other operations of the image processing apparatus 1 to permit cooling of the heater 40 can suppressed. Therefore, a decrease in productivity of the user of the image processing apparatus 1 is suppressed. Heat can still be transferred from the end of the heater 40 in the y-direction to the center through the heat conductor 49. Since the heat generation amount of the central heat generating element 45*a* can be suppressed in this manner, an increase in power consumption of the heating unit 30 is suppressed.

The first grease layer 49*g* can be formed of the same material as the second grease disposed on the inner surface of the cylindrical film 35. Accordingly, the manufacturing cost is reduced.

In some embodiments, the image processing apparatus 1 may be a decoloring apparatus, and the heating unit may be a decoloring unit. The decoloring apparatus is configured to decolor or erase an image formed on a sheet by a decolorable toner. The decoloring unit heats the decoloring toner image formed on the sheet passing through the nip to decolorize the toner image.

According to at least one embodiment described above, the heating unit 30 has the first grease layer 49*g* disposed between the heater 40 and the heat conductor 49. The first grease layer 49*g* has a consistency grade of no more than three. As a result, it is possible to suppress a decrease in sliding performance between the heater 40 and the cylindrical film 35.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A heating device, comprising:

a cylindrical film arranged to be rotated about an axis;

a heater having a first side facing an inner surface of the cylindrical film, wherein the heater extends along a longitudinal direction parallel to the axis and comprises a plurality of heating elements arranged in a line along the longitudinal direction, and the heating elements include a center heating element and a pair of end heating elements that are independently controllable with respect to the center heating element;

a heat conductor on a second side of the heater opposite the first side, the heat conductor extending along the longitudinal direction; and a first grease layer between the heat conductor and the second side of the heater and having a consistency grade less than or equal to three.

2. The heating device according to claim 1, wherein the first grease layer does not contain a thermally conductive filler.

3. The heating device according to claim 1, wherein the first grease layer has a thermal conductivity less than 1 W/m·K.

4. The heating device according to claim 1, further comprising:

a second grease layer on the inner surface of the cylindrical film.

5. The heating device according to claim 4, wherein the second grease layer comprises the same material as the first grease layer.

6. The heating device according to claim 4, wherein one of the heating elements contacts the second grease layer.

7. The heating device according to claim 1, further comprising:

a roller that forms a nip with the cylindrical film through which an object to be heated passes.

8. The heating device according to claim 1, further comprising:

a first temperature sensor between the axis of the cylindrical film and the heat conductor.

9. The heating device according to claim 1, wherein the first grease layer comprises a base oil that is fluorinated.

10. The heating device according to claim 9, wherein the first grease layer has a thermal conductivity less than 1 W/m·K, and the first grease layer does not contain a thermally conductive filler.

11. An image processing apparatus, comprising:

a heating device including:

a cylindrical film arranged to be rotated about an axis, a heater having a first side facing an inner surface of the cylindrical film, wherein the heater extends along a longitudinal direction parallel to the axis and comprises a plurality of heating elements arranged in a line along the longitudinal direction, and the heating elements include a center heating element and a pair of end heating elements;

a heat conductor on a second side of the heater opposite the first side, the heat conductor extending along the longitudinal direction, and a first grease layer between the heat conductor and the second side of the heater and having a consistency grade less than or equal to three; and a controller configured to control the heating device for an image processing operation, wherein the controller controls the pair of end heating elements independently with respect to the center heating element.

12. The image processing apparatus according to claim 11, wherein the first grease layer does not contain a thermally conductive filler.

13. The image processing apparatus according to claim 11, wherein the first grease layer has a thermal conductivity less than 1 W/m·K.

14. The image processing apparatus according to claim 11, wherein the heating device further includes a second grease layer on the inner surface of the cylindrical film.

15. The image processing apparatus according to claim 14, wherein the second grease layer comprises the same material as the first grease layer.

16. The image processing apparatus according to claim 11, wherein the first grease layer comprises a base oil that is fluorinated.

17. The heating device according to claim 16, wherein the first grease layer has a thermal conductivity less than 1 W/m·K, and the first grease layer does not contain a thermally conductive filler.

18. A method for manufacturing a heating device including a cylindrical film arranged to be rotated about an axis, a heater extending along a longitudinal direction parallel to the axis and having a first side facing an inner surface of the cylindrical film, the heater including a plurality of heating elements arranged in a line along the longitudinal direction, the heating elements including a center heating element and a pair of end heating elements that are independently controllable with respect to the center heating element, and a heat conductor on a second side of the heater opposite the first side and extending along the longitudinal direction, the method comprising:

forming a grease layer on the inner surface of cylindrical film;

arranging the heater to extend along the longitudinal direction with the first side of the heater facing the inner surface;

arranging the heat conductor to be on the second side of the heater and to extend along the longitudinal direction;

generating heat using the heater so that the grease layer flows into a gap between the heater and the heat conductor.

* * * * *